United States Patent [19]

Owen et al.

[11] 3,948,321

[45] Apr. 6, 1976

[54] LINER AND REINFORCING SWAGE FOR CONDUIT IN A WELLBORE AND METHOD AND APPARATUS FOR SETTING SAME

[75] Inventors: Harrold D. Owen, Fort Worth; Robert Lee Roper, Burleson; J. C. Smith, Fort Worth; James Douglas Young, Crowley, all of Tex.

[73] Assignee: Gearhart-Owen Industries, Inc., Fort Worth, Tex.

[22] Filed: Aug. 29, 1974

[21] Appl. No.: 501,695

[52] U.S. Cl. ..... 166/277; 166/207; 166/63; 166/217

[51] Int. Cl.[2] ..... E21B 23/04; E21B 43/10

[58] Field of Search ..... 166/277, 207, 206, 63, 166/299, 315, 122, 192, 217; 29/522, 523; 137/15

[56] References Cited

UNITED STATES PATENTS

| | | | |
|---|---|---|---|
| 3,186,485 | 6/1965 | Owen | 166/63 |
| 3,191,677 | 6/1965 | Kinley | 166/277 |
| 3,412,565 | 11/1968 | Lindsey et al. | 166/207 UX |
| 3,498,376 | 3/1970 | Sizer et al. | 166/207 X |
| 3,669,190 | 6/1972 | Sizer et al. | 166/207 X |
| 3,712,376 | 1/1973 | Owen et al. | 166/63 X |
| 3,746,091 | 7/1973 | Owen et al. | 166/207 |
| 3,776,307 | 12/1973 | Young | 166/207 X |

*Primary Examiner*—Stephen J. Novosad
*Attorney, Agent, or Firm*—Wm. T. Wofford

[57] ABSTRACT

Method and apparatus for emplacing a liner in a conduit in a well penetrating subterranean formations characterized by suspending at a predetermined depth in the well at least one annular liner having an annular body portion and an adjacent, concentrically disposed swage means that is adapted for being driven interiorly of the body portion for expanding the latter outwardly into contact with the conduit; firing a setting tool in the method to drive the swage means concentrically interiorly of the body portion; and removing the setting tool, leaving the swage and the body portion set in the conduit with a large bore penetrating longitudinally thereof. Also disclosed are straddle patches having a liner at each end, either set in a unitary operation or set by a two-step operation; other combinations employing the liners and the specific apparatus for setting the liners.

44 Claims, 10 Drawing Figures

LINER AND REINFORCING SWAGE FOR CONDUIT IN A WELLBORE AND METHOD AND APPARATUS FOR SETTING SAME

BACKGROUND OF THE INVENTION

1. Field of the Invention

This invention relates to apparatus for use in wells penetrating subterranean formations. More particularly, it relates to liners; and packers, straddle patches, seal subs and other combinations of apparatus employing the liners in casing or tubing in an oil well or the like.

2. Description of the Prior Art

As described in U.S. Pat. Nos. 3,712,376, entitled "Conduit Liner for Wellbore and Method and Apparatus for Setting Same," inventors, Harrold D. Owen, Wayne O. Rosenthal and James Douglas young; U.S. Pat. No. 3,746,091, entitled "Conduit Liner for Wellbore," inventors, Harrold D. Owen, Wayne O. Rosenthal and James Douglas Young; U.S. Pat. No. 3,776,307, entitled "Apparatus for Setting a Large Bore Packer in a Well," inventor, James Douglas Young; the prior art is replete with practical and impractical liners, alone or in combinations forming or using packers, seal subs and tubular elements. The descriptive matter of these patents is incorporated by reference.

As a part of the prior art, metal liners have been set by being expanded outwardly into tight frictional engagement with the conduit; such as the casing or tubing. The degree and type of tight frictional engagement depends, of course, on the use, or application, for which the liners are intended. For most applications, the liners are set with a tightness that prevents unwanted movement longitudinally of the conduit. Frequently, the liners are set with both tight frictional and sealing engagement, as will be apparent from a description of specific embodiments hereinafter. The tight frictional engagement provides a finite force that is designed for retaining the liner in place to do its job. Obviously, forces larger than design can be generated that are large enough to move the set liner longitudinally of its conduit.

Liners or plugs have been set in a well by detonation of explosive within enclosed chambers or about mandrels within a conduit; bridge plugs have been set by drawing a mandrel up within an expansible annular body and leaving the mandrel emplaced within the annular body; although blocking the well. Liners have also been set by driving an expanding body upwardly or downwardly into and through an expansible body retained in position in the well by supplemental anchor or support means such as a tubing stop or a string of conduit supported on the bottom of the well. Liners have been set by hydraulically forcing a swaging mandrel or swage means upwardly through corrugated liners held in place by the tubing string. Liners have also been set by jarring by repeated firing of an explosive jar brought to the surface and reloaded between firings and by explosively driving a swage means upwardly or downwardly through a corrugated liner held in place by a frangible member with a second explosive charge within the frangible member to destroy it.

The difficulties with the prior art type liners and packers were delineated in the referenced patents and improved liners, straddle patches, packers and method of setting them were described.

Even with the improved structures described in the referenced patents, there are applications in which it is advantageous to employ a relatively thin walled liner in order to lower the forces required for setting the liner and still have the ability to withstand relatively large pressures and to hold the tight frictional and sealing engagement with the conduit in the well (that was often absent in the thin walled liners of the earlier prior art).

Accordingly, it is an object of this invention to provide method and apparatus to be employed to set one or more liners in a well that obviates the disadvantages of the prior art, has a relatively thin walled liner in the unset position but has a set liner that has sufficient wall thickness and strength to withstand the design pressure and sustain design loads without displacement longitudinally of the well.

It is also an object of this invention to provide improved method and apparatus that effects a set liner in which an interior concentrically disposed portion of the liner is in compression to reinforce the exterior portion of the liner that is in tension for a surprisingly strong set liner that has many applications in which it can be employed.

These and other objects will become apparent from the descriptive matter hereinafter, particularly when taken in conjunction with the drawings.

In accordance with this invention, as will be seen hereinafter, a relatively thin walled, expansible liner having an annular body portion with a swage means positioned adjacent thereto is set in the conduit by driving the swage means concentrically interiorly of the body portion and expanding it radially outwardly into tight frictional and sealing engagement with the casing, or tubing, in the well penetrating the subterranean formations. This invention is widely useful in several combinations employing one or more liners with a tubular element depending from a top liner and having an unusually large bore penetrating longitudinally therethrough.

DESCRIPTION OF PREFERRED EMBODIMENTS

Figure 1:
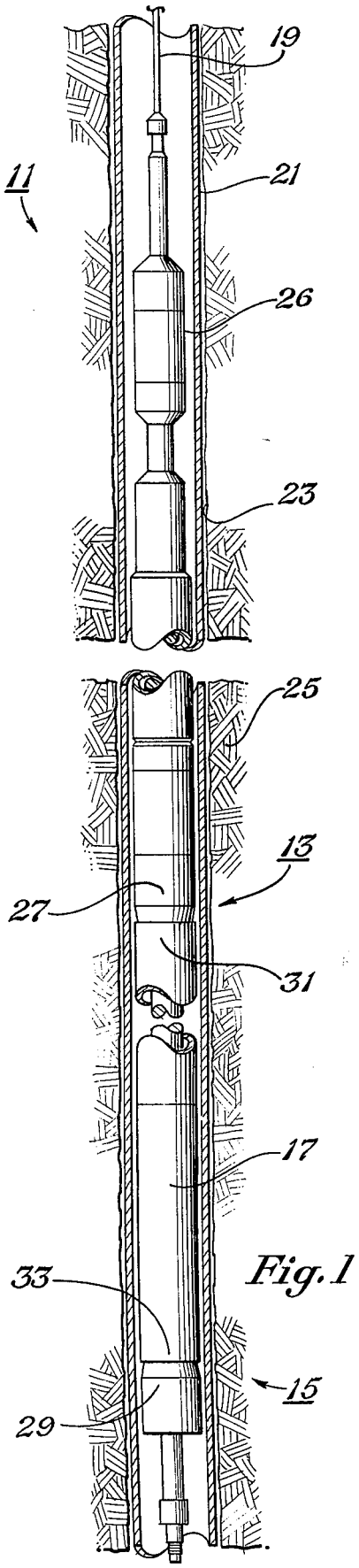
FIG. 1 is a schematic elevational view of the liner and apparatus for setting it in a casing in a well penetrating subterranean formations, in accordance with one embodiment of this invention.

Referring now to the drawings, FIG. 1 illustrates a setting tool device 11 connected with top and bottom liners 13 and 15 sealingly connected with a tubular sleeve 17 therebetween, all suspended from a wireline 19 at a predetermined depth in a section of casing 21 in wellbore 23 penetrating subterranean formations 25. A collar locator and cable head assembly 26 is ordinarily included to facilitate accurate emplacement of the liner and withdrawal of the setting tool device.

The setting tool device 11 is illustrated in the aforementioned U.S. Pat. Nos. 3,712,376 and 3,746,091 and is described in detail in U.S. Pat. No. 3,186,485, entitled "Setting Tool Device," inventor Harrold D. Owen. Reference is made to those patents for detailed description of the construction and operation of the setting tool device. Broadly, the setting tool device 11 is a type of force generating means wherein a piston assembly and a cylinder assembly are powered for movement relative to each other by an ignitable charge in the tool. Briefly, the setting tool device 11 includes a fluid actuated means comprising a head assembly including igniter means; a cylinder assembly; and a piston assembly within the cylinder assembly, with the piston assembly being slidable relative to the cylinder assembly; and means including a combustion chamber adapted for receiving a combustible charge and disposed within the cylinder assembly for imparting relative movement to the cylinder assembly and the piston assembly. When the setting tool device 11 is connected with the opposite ends of the portions of the liners 13 and 15, as described hereinafter, this relative movement is translated into a movement of respective top and bottom swage means 27 and 29 concentrically within expansible annular body portions 31 and 33 of the respective liners 13 and 15. Because the setting tool device 11 imparts both the force and reactive force that act on the respective top and bottom liners 13 and 15 for setting them, the tendency for movement longitudinally of the casing 21 is neutralized so no slips or other anchoring means are required for effecting the setting of the liner. Expressed otherwise, a straddle patch formed by the liners 13 and 15 sealingly connected with the tubular sleeve is set while the force and reaction force are still acting thereon to neutralize any tendency to move, or change depth.

For ease of explanation, setting tool device 11 is illustrated in FIGS. 2A-4B as having its piston assembly connected with the bottom liner 15 and its cylinder assembly connected with the top liner 13. Adapter means are available to effect the converse connection in which the cylinder assembly is connected with the bottom liner 15 and the piston assembly is connected with the top line 13, if desired.

Figure 2A:
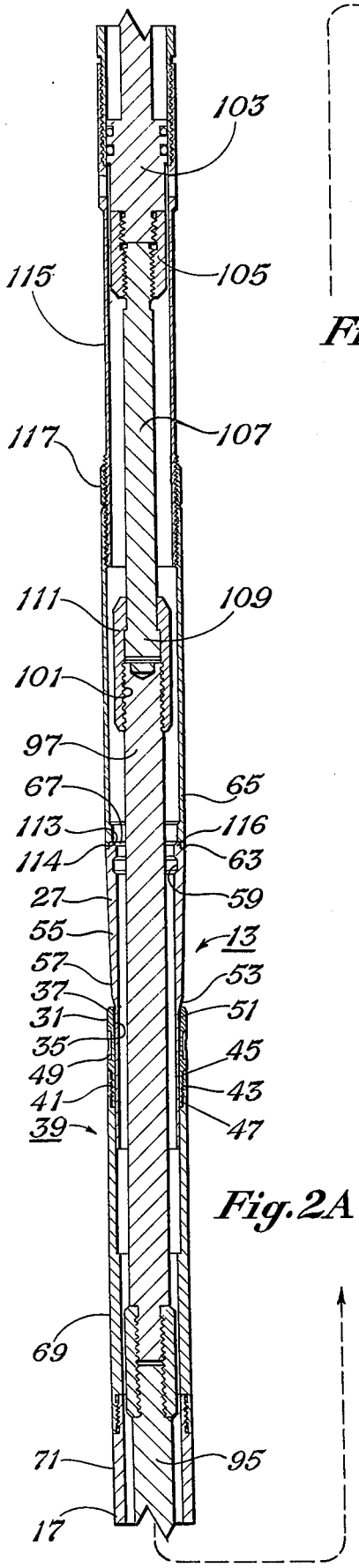
FIGS. 2A and 2B are fragmentary longitudinal sectional views of, respectively, the upper and lower parts of the straddle patch and setting apparatus of FIG. 1 in one operative and pre-set position.

Referring to FIG. 2A, the liner 13 includes an annular body portion 31 and a swage means, or swage, 27.

The annular body portion 31 has interior and exterior surfaces 35 and 37 that define cylinders that are at least partially coextensive. The body portion 31 has an outside diameter less than the diameter of the casing, or conduit; has sufficient malleability for and is adapted for being expanded to conformingly engage the casing in tight frictional and sealing engagement. The body portion 31 of the liner 13 has a modulus of elasticity in compression sufficient to retain tight frictional engagement with the casing 21 after being expanded thereagainst, particularly when reinforced by the swage 27 driven interiorly thereof, and prevent being displaced upwardly or downwardly by forces normally expected to be imposed on the liner 13.

Ordinarily, the annular body portion 31 is made of soft steel that is compatible with downhole tubular goods and thus forms a metal seal ring that does not create galvanic action or otherwise intensify localized corrosion when set in the wellbore. A particularly preferred metal for the liner is set forth in the aforementioned U.S. Pat. No. 3,746,091.

As illustrated, the liner 13 contains suitable seal means 49 for ensuring a fluid impermeable connection between it and the casing 21. Specifically, the seal means 49 comprises a molded, oil and gas resistant rubber seal ring that slightly exceeds the outside diameter of the outer surface 37 of the body portion 31. Tests indicate that the annular body portion 31 will form a metal-to-metal seal inside clean pipe, but the seal means 49 ensures sealing regardless of whether or not the pipe, or casing, is clean.

The swage 27 includes three portions. The first portion is a thin annular stinger 51 that is disposed concentrically interiorly of the inner surface 35 of the annular body portion 31 of the liner 13. This retains alignment and facilitates forcing of the swage 27 correctly within the annular body portion 31 for expanding it outwardly into tight frictional and sealing engagement with the casing 21. The second portion is a short frusto-conical section 53. The short frusto-conical section 53 effects most of the radially outward expansion of the annular body portion 31 before it comes into contact with the casing 21. Accordingly, the short frusto-conical section 53 has a relatively large taper for effecting the relatively easy expansion of the annular body portion with the high forces initially generated by the setting tool device 11. The third portion of the swage comprises an elongate frusto-conical section 55 for forcing the annular body portion 31 outwardly into the tight frictional engagement with the casing 21; and thereafter, retaining tight frictional and sealing relationship between the set annular body portion 31 that is in tension and the swage 27 that is in compression. The elongate frusto-conical section 55 has an outer surface 57 that is tapered. With the alloys tested to date, there is a critical angle of taper with respect to the central longitudinal axis of the swage 27 within the range of 1°–5°. With an angle of less than 1°, the final and difficult frictional and sealing contact of the annular body portion 31 with the casing 21 is not always satisfactorily effected. With more than 5°, the swage 27 is not driven inwardly interiorly of the annular body portion 31 sufficiently and has a tendency to become loosened following setting. Preferably, the taper is at an angle of between 1½ and 3° for best results.

As can be seen, the swage 27 is tubular and is formed of high strength metal that has a high modulus of compression such that it can force the annular body portion 31 outwardly into the tight frictional engagement with the casing 21 without being compressed sufficiently that the internal dimensions of the bore penetrating longitudinally therethrough is decreased to any significant amount. Ordinarily, high strength steel will be employed so as to be compatible with the annular body portion 31 and the other tubular goods employed in the well, since the swage 27 will be left in place to reinforce the annular body portion 31.

Figure 2B:
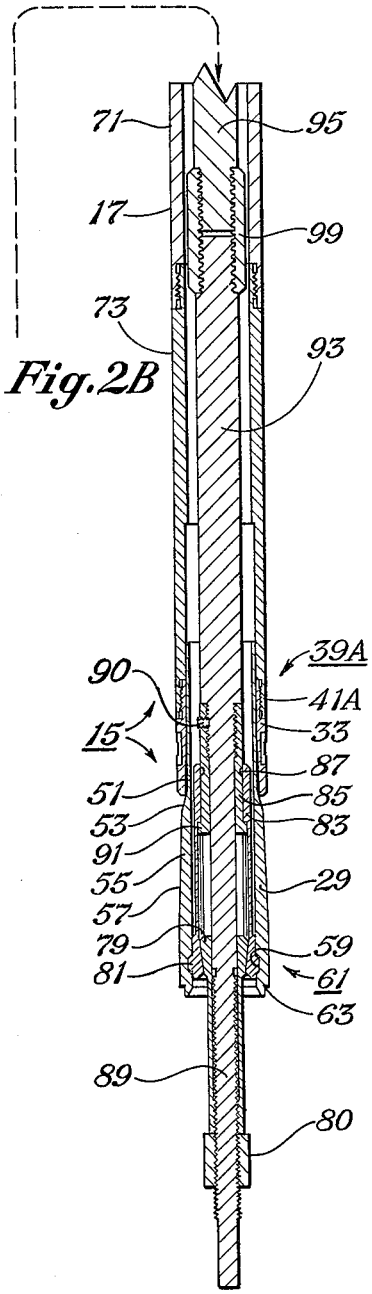
Figure 3:
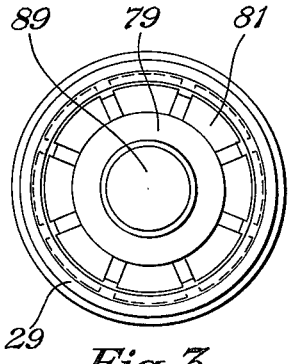
FIG. 3 is a bottom end view of the apparatus of FIG. 2B.

For standardization in manufacture, the swage means 27 has an interiorly disposed annular groove 59 formed therein, as by machining, for being connected with a reaction force setting means 61, FIG. 2B, and a top exteriorly disposed annular groove 63 for engagement with a setting sleeve means 65, FIG. 2A. Thus, the swages 27 are interchangeable and used as either top or bottom swages 27 and 29. As illustrated, the swage 27 has a radially interiorly sloping frusto-conical section 67 facilitating entry into its top of any tool desired to be run through the bore penetrating longitudinally therethrough after the liner 13 has been set in the casing 21.

A connector means 39 is connected at its one end with the body portion 31 and at its other end with the tubular sleeve 17. The connector means 39 has an expansible portion 41. The expansible portion 41 may be integrally formed with the liner 13; may be affixed by any suitable expansible joint; for example, it may be thermally joined thereto, as by welding or silver soldering, all as described in the aforementioned U.S. Pat. Nos. 3,712,376 and 3,746,091. As illustrated herein, however, the top of the connector means 39 and the bottom of the body portion 31 are connected by means of threaded connection 43 for sealing even after expansion of expansible portion 41 and the liner 13 into their set position engaging the casing 21. Suitable O-ring 45 and 47 are employed to ensure sealing interconnection between the connector means 39 and the liner 13.

Similarly as described with respect to the connection between the liner 13 and the connector means 39, the connector means 39 may be connected with the tubular sleeve 17 by any suitable interconnection. As illustrated, the connector means 39 is formed integrally with a top section of the tubular sleeve 17. Any of the other types of interconnections delineated hereinbefore and in the aforementioned U.S. patents, or any other suitable interconnection means may be employed, if desired. Ordinarily, the connector means will comprise steel that is compatible with the tubular goods in the well, similarly as described hereinbefore with respect to the liner 13 and the tubular sleeve 17.

The tubular sleeve 17 is illustrated as comprising a plurality of sections 69, 71 and 73, etc. to make up the desired length of the straddle patch. Respective sections of tubular sleeve are ordinarily steel pipe, such as is employed in forming straddle patches. By use of a plurality of sections sealingly connected together, any desired length straddle patch may be formed from only two feet or so up to as much as 50 feet or more in length.

Referring to FIG. 2B, the bottom end of the tubular sleeve 17 is sealingly connected with the bottom liner 15 to form a straddle patch for emplacing in casing 21 for blocking a communicating passageway between the interior of the casing 21 and the exterior thereof; for example, to patch a hole in the casing. Specifically, the bottom liner 15 is threadedly connected with an expansible portion 41A of a bottom connector means 39A that is integrally formed with the bottom section 73 of the tubular sleeve 17. The interconnection employs the same threaded connection and O-rings described hereinbefore with respect to connector means 39 to ensure that the liner 13 is sealingly connected with the connector means 39A after expansion of the liner 15 outwardly into tight frictional and sealing engagement with the casing 21. Thus, the top of the annular body portion 33 of the bottom liner 15 is sealingly connected with the tubular sleeve 17. The bottom liner 15, as implied, is a mirror image, top to bottom, of the top liner 13 and has the same elements as described with respect to the liner 13; namely, the annular body portion 33 and the swage means, or swage 29. The swage 29 has the same construction as the swage 27 described hereinbefore, similarly as the annular body portion 33 has the same construction and seal means as the annular body portion 31.

As illustrated, the bottom swage 29 is retained in its longitudinal spaced relationship with the annular body portion 33 by way of the reaction force setting means 61.

Figure 4A:
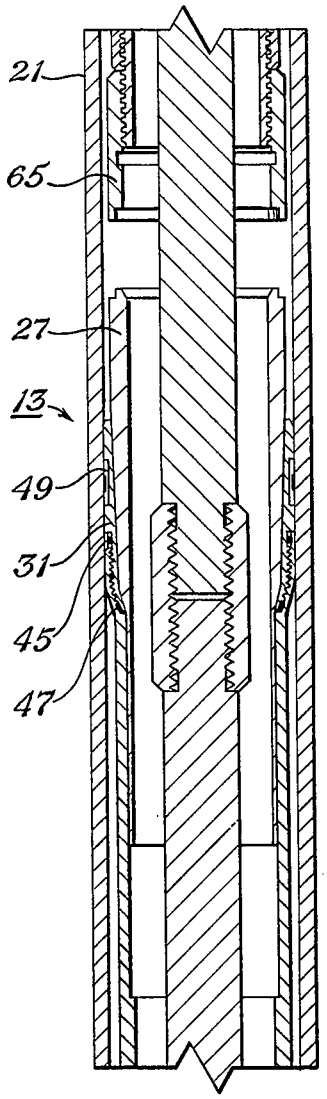
FIG. 4A and 4B are fragmentary longitudinal sectional views of, respectively, the upper and lower parts of the apparatus of FIGS. 2A and 2B in another operative and set position.
Figure 4B:
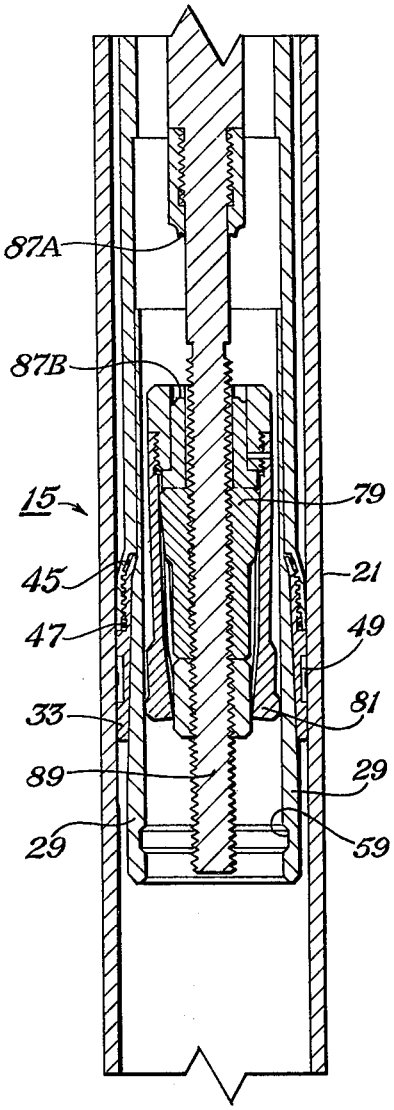

The reaction force setting means 61 serves as a vital link in transmitting the reaction force of the setting tool device to oppose movement of the one or more liners being set by the force of the setting tool device, and obviates the need for supplemental anchors, etc., as indicated hereinbefore. The reaction force setting means 61 is removable upwardly through the tubular sleeve 17 and the casing 21 after the top and bottom liners 13 and 15 have been set. Specifically, and as illustrated, the reaction force setting means 61 includes an inverted frustum 79 and a plurality of collet fingers 81 engaging the internal annular groove 59. The inverted frustum 79 is screwed onto the bottom threaded portion of an adapter rod 89 so as to move in unison with the adapter rod 89. A lock nut 80 is employed to lock it into predetermined position for correct assembly. The collet fingers 81 are normally biased radially inwardly and are supported radially on the inverted frustum 79 before setting such that they engage the internal annular groove 59 for moving the swage 29 in conjunction with the adapter rod 89 that is connected with the piston assembly of the setting tool 11. The collet fingers are integrally connected with a longitudinally disposed tubular ring 83 that slidably engages the exterior portion of a release sleeve 85. The release sleeve 85 has a weak portion 87 that is parted by sufficient tensile force greater than the force required to drive the swage 29 interiorly of and set the annular body portion 33 of the liner 15. The release sleeve 85 is threadedly connected to the adapter rod 89 and prevented from unscrewing by set screw 90, or any other suitable means. The release sleeve 85 has an annularly protruding shoulder 91 that pulls against the ring 83, in turn pulling against the collet fingers 81 and the swage 29 as the adapter rod 89 is pulled. When the weak portion is parted, however, as illustrated in FIG. 4, the adapter rod 89 and the inverted frustum 79 are allowed to move relative to the set liner 15, including the swage 29. Consequently, the collet fingers 81 are allowed to collapse from out of the internal annular groove 59. The collapsed collet fingers 81 are then pulled upwardly by the upwardly moving inverted frustum. As a result, they move upwardly through the tubular sleeve 17 and the set liners 13 and 15.

The adapter rod 89 passes through the top and bottom liners 13 and 15 and is connected at its lower end with the swage 29 via the reaction force setting means 61 described hereinbefore. The adapter rod is adapted for connection at its other end with a force generating means, such as the setting tool device 11, for subjecting the swage 29 to a force acting upwardly, or reaction force, for pulling the swage 29 interiorly of the bottom annular body portion 33. As illustrated, the adapter rod 89 comprises a plurality of sections such as bottom rod 93, intermediate rods 95 and top rod 97 joined by respective tandem connectors 99. The top rod 97 has a quick change threaded section 101 to facilitate connection with the setting tool device 11. The bottom piston 103 of the piston assembly of the setting tool device 11 is threadedly connected by adapter 105 with a quick change rod 107. The quick change rod 107 has an enlarged portion 109 with a quick change nut 111 thereover for connecting with the quick change threaded section 101. This allows the casing patch and the setting tool device 11 to be assembled separately and joined quickly together at the well site.

The setting sleeve means 65 is disposed radially of the central axis of the adapter rod 89. As illustrated, the setting sleeve means 65 encircles the adapter rod 89 and has its lower end portion engaging the top of the swage 27 for transmitting the setting force. Specifically, the setting sleeve means 65 has an interior annular groove 113 and shoulder 114 that conformingly mate with the shoulder 116 and the exterior annular groove 63 of the swage 27 for imparting the force necessary to drive the swage 27 concentrically interiorly of the annular body portion 31 for expanding the latter outwardly against the casing 21. The setting sleeve means 65 is adapted at its upper end portion for connection with the force generating means for imparting the force necessary for driving the swage 27 downwardly within the annular body portion 31 of liner 13. As illustrated, the setting sleeve means 65 comprises a tubular structure that is threadedly connected to the bottom end of the sleeve screw 115 and locked in place by lock nut 117. The sleeve screw 115 is a tubular member that is connected with the cylinder assembly of the setting tool device 11. Consequently, the relative movement imparted to the piston assembly and the cylinder assembly of the setting tool device 11 will be imparted, respectively, to the setting sleeve means 65 and the adapter rod 89.

In operation, the casing patch formed by the top and bottom liners 13 and 15 with the tubular sleeve 17 sealingly connected therebetween by the respective connector means 39 and 39A, is assembled as illustrated in FIGS. 2A and 2B. The setting tool device 11 is assembled in the conventional manner. The two are joined by the quick connect nut 111 and the quick connect threaded section 101 and by the sleeve means 65 to form the overall tool. Any desired adjustments are made to get the setting tool device 11 armed and the respective swages positioned correctly with respect to the adjacent body portions of the respective liners. The overall tool is inserted through conventional well head and lubricator equipment and lowered to the desired depth on wireline 19.

As indicated hereinbefore, once the liners are accurately positioned at the desired depth in the conduit in the well, the force generating means comprising an ignitable charge in the setting tool device 11 is actuated.

The detailed operation of the setting tool device 11 in moving the respective swages interiorly of their adjacent annular body portions is the same as explained in the aforementioned U.S. Pat. Nos. 3,712,376 and 3,746,091 regarding moving swages through liners; and need not be repeated in detail herein. It is sufficient to note that upon firing of the charge, there is relative movement, after shearing of a shear pin holding the cylinder assembly and the piston assembly together. The relative movement between the piston assembly and the cylinder assembly is translated into relative movement of the setting sleeve means 65 and the adapter rod 89, as indicated hereinbefore. The oppositely directed movement of the respective swages 27 and 29 move the swages interiorly of their adjacent body portions. Consequently, normally in a single stroke, the respective liners 13 and 15 are set. Specifically, the swages 27 and 29 are forced interiorly of their respective top and bottom annular body portions 31 and 33, thereby expanding the annular body portions outwardly into tight frictional and sealing engagement with the casing 21 in the well. For example, the top swage 27 will have been driven downwardly interiorly of the annular body portion 31 of the top liner 13 by the force imparted via the setting sleeve means 65. Thus, the top liner 13 remains set in place with the swage 27 reinforcing the annular body portion 31. After the respective top and bottom liners 13 and 15 have been set and the respective expansible portions 41 of their connector means expanded therewith, the force and reaction force increase until they become great enough to sever the weak portion 87 of the relief sleeve 85, as indicated by 87A and 87B, FIG. 4B. This allows the adapter rod 89 and the inverted frustum 79 to move upwardly in unison with respect to the collect fingers 81. Movement of the inverted frustum 79 from beneath, or radially interiorly of, the collect fingers 81 allow the collet fingers 81 to collapse radially inwardly out of the annular groove 59 in the swage 29, leaving the bottom liner 15 set in place with the swage 29 driven interiorly of the annular body portion 33.

The setting tool may then be moved upwardly out of the set straddle patch, including the set top liner 13.

The swages 27 and 29 reinforce the annular body portions 31 and 33 and form strong liners 13 and 15. The liners are particularly strong, since the annular body portions are in tension and the swages are in compression; and the tight frictional and sealing engagement with the casing 21 is maintained. The respective seal means 49 further ensure the sealing engagement with the casing 21.

Figure 5:
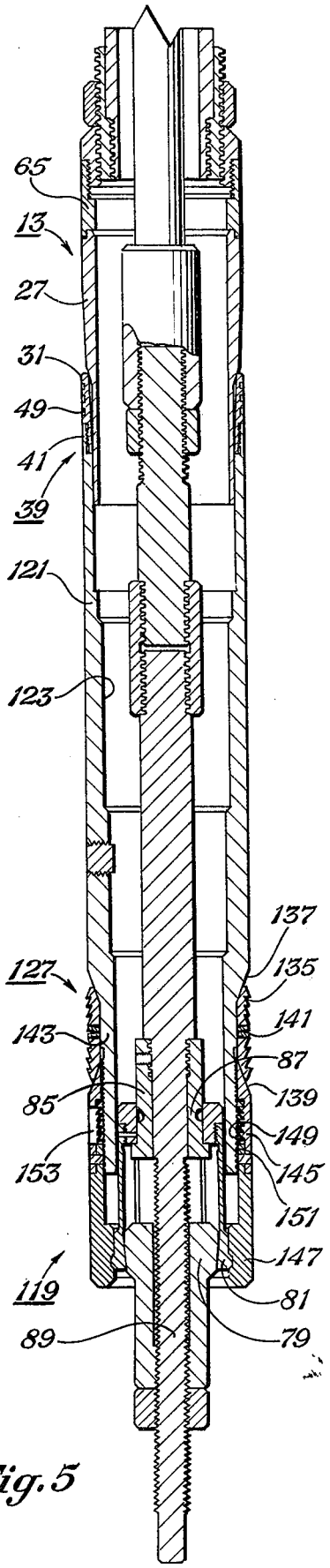
FIG. 5 is a fragmentary cross sectional view of a large bore packer embodiment of this invention, with the setting apparatus inserted therewithin for setting in the well.
Figure 6:
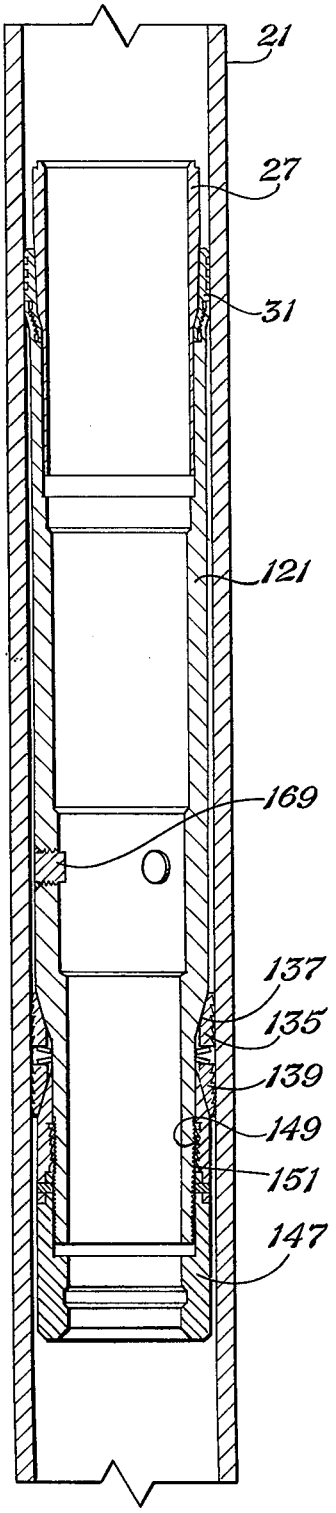
FIG. 6 is a fragmentary cross sectional view of the packer of FIG. 5 set in conduit in the well.

Other embodiments of the invention are illustrated in FIGS. 5–8. For example, FIGS. 5 and 6 illustrate a large bore packer similar to that described in the aforementioned U.S. Pat. No. 3,776,307 but having the improved liner of this invention. Specifically, a large bore packer assembly 119 includes the top liner 13 having the annular body portion 31; the respective seal means 49 and the swage 27. A connector means 39 is connected with the body portion 31 and at its other end with a seal sub 121. The connector means 39 has the expansible portion 41 and is connected as described hereinbefore, respectively, with the liner 13 and the seal sub 121.

The seal sub 121 has a seal surface 123 defining an internal bore and extending longitudinally thereof. The seal surface 123 is provided with a smooth finish for sealing engagement with a seal unit, seal nipple, packer or the like that it is to sealingly receive.

The packer assembly 119 includes retainer means 127.

The retainer means 127 is settable for retaining the seal sub 121 at a set depth by supplementing the force exerted by the liner 13 when it is expanded into the tight frictional and sealing engagement with the casing 21. The retainer means 127 has a preset outside diametral dimension less than the diameter of the casing 21 and is expansible radially outwardly into positive mechanical engagement with the casing 21 upon setting at the desired depth. The retainer means 127 is lockable into its expanded and set position. Specifically, the retainer means 127 comprises a pair of slips 135 held in position intermediate spaced apart ramps 137 and 139 via suitable means. Cone springs 141 are disposed intermediate the slips 135 so as to prevent loosening of the slips after they have been set. Ordinarily, the ramps 137 and 139 comprise frusto-conical sections, that are commonly referred to as cones, for setting the slips. As illustrated, the cone ramp 137 is an integral part of the seal sub 121 that also has an interiorly extending cylindrical portion 143.

The frusto-conical ramp 139 and its body are disposed exteriorly of the interiorly extending cylindrical portion 143 and are movable longitudinally thereof to move the spaced apart cones 137 and 139 more closely together for setting the slips 135. The body actually comprises a lock ring 145 and a force ring 147. The lock ring 145 has interiorly protruding ratchet teeth 149 that co-act with exteriorly extending ratchet teeth 151 that are formed on the cylindrical portion 143 to form a locking ratchet for locking the ramps 137 and 139 into a set position when they are moved more closely together to expand the slips 135 outwardly into contact with the casing 21. The lock ring 145 has a plurality of slots 153 that are spaced around it and extend longitudinally for a short distance to allow the requisite flexibility for the ratchet teeth to engage each other for locking, yet ratchet over each other for movement of the body longitudinally upwardly for setting. The ratchet teeth on the respective interior cylinder 143, as well as lock ring 145 are, in fact, continuous peripheral rings interiorly and exteriorly of their respective supports. The teeth rings have inversely inclined mating surfaces to prevent slipping of the teeth with respect to each other once they are engaged. Thus, once the retainer means 127 is set, it is locked into position and cannot slip, or fail to provide the supplemental support needed for resisting displacement longitudinally of the casing 21 by any unusually large force, such as high differential pressure or high weight imposed on the packer assembly 119.

In operation, the liner 13, seal sub 121 and retainer means 127 are emplaced adjacent the respective setting elements that are connected with the setting tool device 11 for being lowered into the well to a given depth and set in the casing 21. Specifically, the swage 27 is disposed adjacent the setting sleeve means 65 and the retainer means 127 is disposed adjacent the ratchet fingers 81 and the inverted frustum 79 on adapter rod 89. The packer assembly 119 is accurately positioned at a give depth in the well; for example, by use of the collar locator. Thereafter, a setting tool device 11 is activated to emplace the liner 13, seal sub 121 and retainer assembly 127 at the desired depth. Specifically, the swage 27 is driven downwardly interiorly of the annular body portion 31, forcing it outwardly into tight frictional and sealing engagement with the casing 21, as illustrated in FIG. 6.

The relative movement between the piston assembly and the cylinder assembly of the setting tool device 11 effects relative movement for setting the liner 13 and the retainer means 127. The liner 13 is set as described hereinbefore.

Considering specifically the setting of the retainer means 127, upon initial movement in the illustrated embodiment, the force ring 147 is forced upwardly by collet fingers 81 to move the ramps, or cones, 139 upwardly and set the slips 135 into engagement with the interior walls of the casing 21. Simultaneously, the ratchet lock is engaged to hold the set position. When sufficient force has been reached, the weak portion 87 of the release sleeve 85 is sheared, moving the inverted frustum 79 upwardly, allowing the collet fingers 81 to move radially interiorly and retract their outside diametral dimension sufficiently to pass upwardly within the force ring 147 and the retainer means 127.

Following the setting operation, the setting tool device 11 and the respective accessories, such as the adapter rod 89 and the setting sleeve means 65, are removed from the well, leaving the packer assembly 119 in place. The packer assembly has an unusually large bore penetrating longitudinally through the seal sub 121 for receiving a large bore seal unit or seal nipple therewithin.

Figure 7:
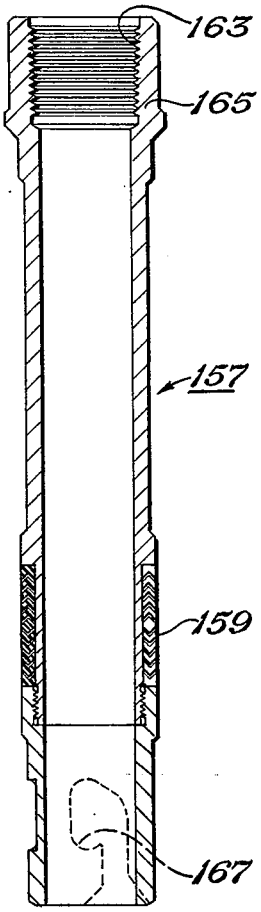
FIG. 7 is a fragmentary cross sectional view of a seal unit for being sealingly inserted within the set packer of FIG. 6.

FIG. 7 illustrates a large seal unit 157 that is suitable for being emplaced within the packer assembly 119. As employed herein, the term "seal unit" includes a packer, a seal nipple and the like for sealing interconnection with another element, such as a string of tubing, or tubular sleeve. Suitable seal nipples have been described in the above referenced U.S. Pat. Nos. 3,746,091 and 3,712,376. The seal unit 157 has a suitable seal means 159 disposed peripherally around a portion of its exterior surface for sealingly engaging seal surface 123 of the seal sub 121. The seal means may be disposed in suitable grooves or in a continuous recess depending upon the nature of the seal employed. As illustrated, the seal unit 157 has, at its top end, suitable receiving means; such as, upset tubing threads 163 in collar 165; for receiving mated threaded connection of tubing or the like for production of fluids from the subterranean formation. As illustrated, the collar 165 is integrally formed with the top end of the seal unit 157. As can be seen in FIG. 7, the seal unit 157 has a plurality of lock slots 167 for latching the seal unit into place over latch stubs 169 protruding interiorly within the seal sub 121, FIG. 6. Latching is effected by insertion and rotation. If desired, the seal unit 157 may be connected on the bottom of any suitable means such as a production liner or tubular sleeve such as described hereinbefore to form a straddle patch or the like.

Figure 8:
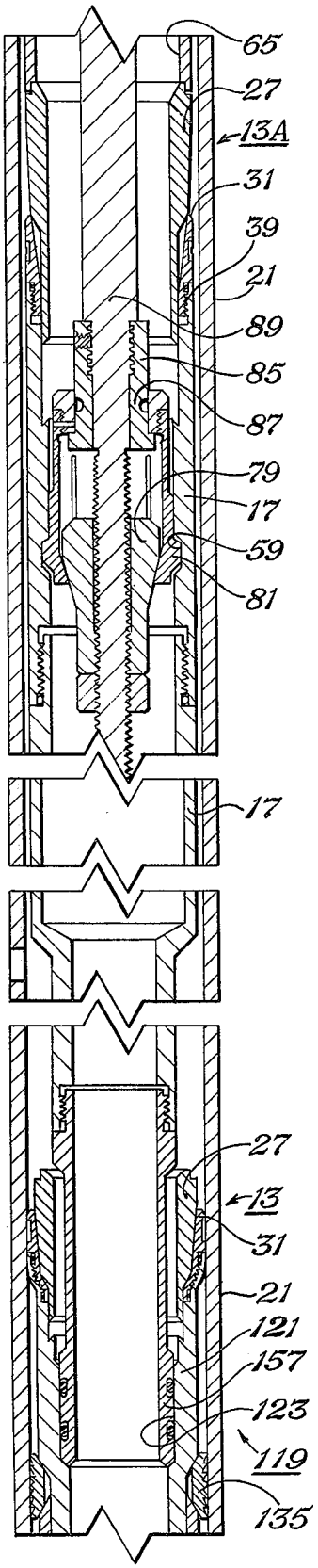
FIG. 8 is a fragmentary longitudinal cross sectional view of still another embodiment of this invention comprising a straddle patch that is set in two stages with a lower end and seal unit set within a larger bore packer that has been previously set.

Such a straddle patch and still another embodiment of this invention is illustrated in FIG. 8. Therein, a large bore packer assembly 119 will have been set as described hereinbefore with respect to FIGS. 5–7. Specifically, as illustrated in FIG. 6, the slips 135 will have been expanded into engagement with the casing 21. Also, the liner 13A will have been expanded outwardly into tight frictional and sealing engagement with the casing 21 by having the annular body portion 31 forced outwardly by the inwardly driven swage 27. A seal unit 157 will have been threadedly attached to the bottom end of a tubular sleeve 17 and lowered into sealing engagement with the seal surface 123.

The tubular sleeve 17 is sealingly connected with and suspended from a suitable top liner 13A via a connector means 39. The resulting assembly is connected to a setting tool device 11 and suspended in the wellbore; for example, as illustrated in FIG. 1. This two-step method of emplacement of a straddle patch may be necessary where the wellbore, or casing 21, is restricted by bends or the like such that two large diameter liners 13, coupled by an elongate sleeve therebetween, could not pass; whereas a short packer could pass and a single large diameter liner at the top could pass. The elements of the apparatus are substantially the same as have been described hereinbefore. Specifically, at the top end of the tubular sleeve, the liner 13A includes the annular body portion 31 described hereinbefore and the swage 27 described hereinbefore, in addition to the connector means 39 described hereinbefore. The swage 27 is disposed adjacent and engaging the setting sleeve means 65 for being driven downwardly into the interior of the annular body portion 31 to expand it outwardly against and in tight frictional and sealing engagement with the casing 21.

Since the tubular sleeve 17 may be quite long; for example, 50 feet; it may be unnecessary to have the adapter rod 89 long enough to traverse completely to the bottom end in order to engage the collet fingers 81 with the bottom end. Moreover, the bottom end is sealingly inserted within the seal sub 121. Accordingly, the interior annular groove 59 is formed in the walls of the tubular sleeve 17 sufficiently below the lowest point of movement of the swage 27 in setting the liner 13A that there is no interference between the relatively moving subassemblies. The collet fingers 81 are then expanded outwardly by proper placement of the inverted frustum 79 to hold the collet fingers 81 in engagement with the annular groove 59 until the liner 13A has been set. The liner is set, as indicated hereinbefore by the downward driving of the swage 27.

If a setting tool is employed to effect the relative movement between the swage 27 and the annular body portion 31, the force will continue to build after the annular body portion 31 has been set into the tight sealing and frictional engagement with the casing 21. Eventually, the force will be great enough to shear the weak portion 87 of the release sleeve 85, as described hereinbefore and illustrated in FIG. 4B. As described with respect to FIG. 4B, the parting of the relief sleeve 85 allows relative movement between inverted frustum 79 and the collect fingers 81. Specifically, the inverted frustum is allowed to move upwardly from beneath the collet fingers and allow them to spring radially inwardly such that the setting tool device 11 can be pulled from the well, along with its accessories to leave the liner 13A set in place at the top of the tubular sleeve 17. As described hereinbefore, the liner 13A is particularly effective since the outer annular body portion 31 is in tension and is expanded into tight frictional and sealing engagement with the casing 21, while the swage 27 has been driven downwardly thereinto in compression to afford a high strength liner that retains the tight frictional and sealing engagement with the casing 21 indefinitely. Since the seal unit 157 sealingly engages the bottom packer assembly 119, the straddle patch is completed, although it has been set in a two stage operation instead of the single stage operation described hereinbefore with respect to FIGS. 1–4B.

General

While the setting tool device 11 and the respectie liners 13 and 15 have been illustrated as being suspended at a predetermined depth in the casing, they may be suspended by any suitable means; such as, a string of pipe, as will sometimes be advantageous when setting in a large diameter conduit, or casing.

The relative motion required to seat the swage means within the expanded annular body portion of the liner has been supplied by a setting tool device 11, but may be effected by any suitable means; such as hydraulically operable means, mechanical movement of two respective strings of conduit, electromechanical means or the like.

In the embodiments illustrated hereinbefore, the top swage means has been illustrated as being driven downwardly into the top annular body portion of the top liner and the bottom swage means has been illustrated as being driven upwardly into the bottom of the bottom liner, simply because this is the easiest way to effect the results. If desired for any reason, the swages may be positioned on the other side of their respective liners employing adapters, such as are illustrated and described in the aforementioned U.S. Pat. Nos. 3,712,376 and 3,746,091. The swages then would be driven in the opposite directions for setting the liners. The end result is the same in that the force and the reaction force for setting the liners oppose each other and cancel any tendency of the liners to move longitudinally of the casing.

While the swages have been illustrated and described hereinbefore as being of standardized construction; if desired, they may be divided into respective top and bottom swages. In the latter case, only the external groove 63 or the internal annular groove 59 need be employed for the respective top and bottom swages.

The respective dimensions of the swages and annular body portions of the respective liners will be preselected in accordance with the pressures that they will be required to sustain and the respective internal dimensions of the conduit against which the liners will be sealingly and frictionally expanded.

If desired, the seal means 49 may comprise O-rings instead of the molded resilient seals illustrated in FIGS. 2A and 5.

The reaction force setting means may comprise any suitable means, instead of the illustrated inverted frustum 79 and collet fingers 81 engaging the internal annular groove 59 of the swage 29. For example, a shearable means could be employed that would shear at a predetermined force greater than that sufficient to set the liner 15.

From the foregoing, it can be seen that this invention achieves the objects delineated hereinbefore and alleviates the disadvantages of the prior art liners, straddle patches, packers, and the like. Specifically, this invention provides all of the advantages delineated in the aforementioned U.S. Pat. Nos. 3,712,376; 3,776,307; and 3,746,091 and, significant as those improvements were, adds the further improvement of allowing use of a relatively thin walled annular body portion that is set in tension and a high strength tubular swage that is set in compression and reinforces the annular body portion to form a high strength liner that is imminently satisfactory and easily set in place; yet has a large bore penetrating longitudinally therethrough. The goods that are employed in this invention create no adverse corrosion problems, such as galvanic cells and the like. One embodiment of this invention has been published in an article by Douglas Young entitled "Casing/Tubing Patch Uses New Seal Idea," PETROLEUM ENGINEER, July 1974, pages 72–79; and the descriptive material of that publication is embodied herein by reference for details that are omitted herefrom.

When the straddle patch is installed in the same diameter pipe at the top and bottom the forces are balanced so there is no tendency for movement longitudinally of the casing or tubing in the well. If desired, of course, the straddle patch can be set in different diameter pipe by setting sealingly interconnected small diameter liner and tubular sleeve (in a smaller and lower section of casing) and a larger diameter top liner and tubular sleeve (in a larger diameter section of casing). This type structure can be employed to correct leaks between change over in diameter of different sections of casing that may be set in the well. A wide variety of other uses, or applications, of this invention will occur to those skilled in this art.

Although this invention has been described with a certain degree of particularity, it is understood that the present disclosure is made only by way of example and that numerous changes in the details of construction and the combination and arrangement of parts may be resorted to without departing from the spirit and the scope of this invention.

What is claimed is:

1. A method for emplacing a liner in a conduit in a well penetrating subterranean formations comprising:

a. suspending at a predetermined depth in said conduit at least one annular liner having a body portion including substantially cylindrical interior and exterior surfaces that are at least partially coextensive, having an outside diameter less than the internal diameter of said conduit, having sufficient malleability for and being adapted for being expanded to conformingly engage said conduit and having a modulus of elasticity in compression sufficient to retain tight frictional engagement with said conduit after expansion thereagainst; said liner also including adjacent said body portion a tubular swage at at least one end for expanding said liner outwardly into said tight frictional engagement with said conduit; said body portion being responsively connected with a reaction force setting means for holding said body portion at the desired setting depth against the force of said swage as said swage is forced interiorly of said body portion; said swage engaging a force generating means also suspended in said conduit for subjecting said swage to a force acting to force said swage into said body portion; and said reaction force setting means engaging said force generating means for subjecting said reaction force setting means and body portion to a reaction force opposing movement of said body portion as said swage is forced thereinto;

b. actuating said force generating means and applying said force to said swage and said reaction force to said reaction force setting means, thereby forcing said swage interiorly of said body portion while said reaction force is still acting on said body portion and expanding said body portion outwardly into said tight frictional engagement with said conduit; and thereafter;

c. removing said force generating means from said well, leaving said liner expanded into said tight frictional engagement with said conduit with said swage forced interiorly of said body portion for reinforcement and having a bore penetrating longitudinally through both said swage and said body portion.

2. The method of claim 1 wherein said swage is forced downwardly interiorly of the top of said body portion and said body portion has an expansible connector sealingly connected with its bottom end and a tubular element is sealingly connected with the bottom end of said expansible connector.

3. The method of claim 1 wherein respective top and bottom said liners are connected via respective expansible connectors with an intermediate tubular element; said top liner is positioned below a top said swage and said bottom liner is positioned above a bottom said swage; said top swage responsively engages a setting sleeve that is connected with one reciprocally movable assembly of said force generating means and said bottom said swage responsively engages said reaction force setting means such that said force and said reaction force on respective said top and bottom swages oppose each other via said tubular element so as to force said top and bottom swages interiorly of and expand both said body portions into tight frictional and sealing engagement with said conduit with said tubular element sealingly connected therebetween and form a patch interiorly of said conduit; and wherein said force generating means is removed from said well after said top and bottom liners have been set by having their respective swages forced interiorly of said body portions and both said liners are left in place with said tubular swages inserted within the body portions for reinforcement and with said bore penetrating through both said liners, connectors, and tubular element.

4. The method of claim 3 wherein said reaction force setting means is collapsed after said bottom liner has been set and said reaction force setting means is withdrawn from said well with said force generating means.

5. The method of claim 1 wherein a resilient seal means is disposed peripherally about said liner before said liner is suspended in said well such that said seal means is compressed into sealing engagement with the interior wall of said conduit when said liner is expanded into said tight frictional engagement with said conduit.

6. The method of claim 1 wherein a critical taper within the range of 1°–5° is provided on the exterior surface of said swage for successful setting and retention in place of said liner.

7. The method of claim 6 wherein a stinger is provided on said swage and said stinger is inserted interiorly within said body portion to maintain said swage concentrically oriented with respect to said body portion before and during actuation of said force generating means.

8. A method of emplacing a straddle patch in a conduit in a well penetrating subterranean formations comprising:

a. suspending at a first predetermined depth in said conduit a first annular liner having a body portion including substantially cylindrical interior and exterior surfaces that are at least partially co-extensive, having an outside diameter less than the internal diameter of said conduit, having sufficient malleability for and being adapted for being expanded to conformingly and sealingly engage said conduit with a tight frictional and sealing engagement and having a modulus of elasticity in compression sufficient to retain said tight frictional and sealing engagement with said conduit after expansion thereagainst; said liner also including adjacent said body portion a tubular swage at at least one end for expanding said liner outwardly into said tight frictional engagement with said conduit; said body portion being responsively connected with a reaction force setting means for holding said body portion at the desired setting depth against the force of said swage as said swage is forced interiorly of said body portion; said liner having a connector means connected at its one end; said connector means having its other end connected with a seal sub and having an expansible portion for retaining sealing interconnection after expansion of said body portion of said annular liner; said seal sub having a longitudinally extending internal sealing surface defining a bore for receiving in sealing relationship a large bore seal unit; said swage engaging a force generating means also suspended in said conduit for subjecting said swage to a force acting to force said swage into said body portion; and said reaction force setting means engaging said force generating means for subjecting said reaction force setting means and body portion to a reaction force opposing movement of said body portion as said swage is forced thereinto;

b. actuating said force generating means and applying said force to said swage and said reaction force to said reaction force setting means, thereby forming said swage interiorly of said body portion while said reaction force is still acting on said body portion and expanding said liner outwardly into said tight frictional and sealing engagement with said conduit; thereafter, c. removing said force generating means from said well, leaving said liner expanded into said tight frictional and sealing engagement with said conduit with said swage forced interiorly of said body portion for reinforcement and having a bore having an unusually large diameter penetrating longitudinally through both said swage and said body portion for insertion of a seal unit within said seal sub;

d. lowering into said well and in sealing relationship with said sub a second annular liner that is connected with a tubular element via a connector means having an expansible portion for maintaining sealing connection after expansion of said second annular liner outwardly into said tight frictional and sealing engagement with said conduit; said tubular element being sealingly connected with a seal unit at its bottom end; lowering said seal unit into sealing relationship with said seal sub and thereby suspending at a second predetermined depth in said conduit said second annular liner having a body portion including substantially cylindrical interior and exterior surfaces that are at least partially co-extensive, having an outside diameter less than the internal diameter of said conduit, having sufficient malleability for and being adapted for being expanded to conformingly engage said conduit and having a modulus of elasticity in compression sufficient to retain tight frictional engagement with said conduit after expansion thereagainst; said second liner also including adjacent said body portion a tubular swage at at least one end for expanding said liner outwardly into said tight frictional engagement with said conduit; said body portion being responsively connected with a force setting means for holding said body portion at the desired setting depth against the force of said swage as said swage is forced interiorly of said body portion; said swage engaging a force generating means also suspended in said conduit for subjecting said swage to a force acting to force said swage into said body portion; and said reaction force setting means engaging said force generating means for subjecting said reaction force setting means and said body portion to a reaction force opposing movement of said body portion as said swage is forced thereinto;

e. actuating said force generating means and applying said force to said swage and said reaction force to said reaction force setting means, thereby forcing said swage interiorly of said body portion while said reaction force is still acting on said body portion and expanding said liner outwardly into said tight frictional engagement with said conduit; and thereafter;

f. removing said force generating means from said well, leaving said liner expanded into said tight frictional engagement with said conduit with said swage forced interiorly thereof for reinforcement and having said bore also penetrating longitudinally through both said second liner and tubular element, as well as through said first liner and seal sub.

9. A combination liner and element for a conduit in a well penetrating subterranean formations and having a given diameter comprising:

a. a liner having:

i. an annular body portion having substantially cylindrical interior and exterior surfaces that are at least partially co-extensive, having an outside diameter less than said given diameter, having sufficient malleability for and adapted for being expanded to conformingly engage said conduit, and having a modulus of elasticity in compression sufficient to retain tight frictional engagement with said conduit after expansion thereagainst; and ii. a tubular swage means adjacent said body portion for expanding said body portion outwardly into tight frictional engagement with said conduit; said swage means being adapted for being forced concentrically interiorly of said body portion and left in place therein after said body portion has been expanded into said tight frictional engagement with said conduit; said tubular swage means having extending longitudinally therethrough a bore that is large enough for passage of downhole tools, well fluids and the like;

b. a tubular element having an outside diameter less than said given diameter for being disposed concentrically interiorly of said conduit in said well; and c. a connector means connected at its one end with said body portion and at its other end with said tubular element; said connector means having an expansible portion for retaining a sealing interconnection after expansion of said body portion.

10. The combination of claim 9 wherein said tubular element comprises an elongate sleeve for serving as a patch and a seal unit is sealingly connected with the bottom end of said sleeve for sealing insertion within a sealing bore of a previously set packer.

11. The combination of claim 10 wherein a presetting alignment means is provided for each said swage means and said body portion to ensure proper insertion of said swage means concentrically within its adjacent body portion.

12. The combination of claim 11 wherein said presetting alignment means comprises a stinger portion disposed concentrically within said body portion and connected with respective said swage means.

13. The combination of claim 12 wherein said liner, said annular body portion and said swage means are referred to as respective first liner, first annular body portion and first swage means; said first swage means being disposed above said first annular body portion with its said stinger portion extending concentrically interiorly of said annular body portion; a second connector means is sealingly connected to the bottom of said tubular element; said second connector means has its expansible portion sealingly connected with a second liner having a second annular body portion and having a second swage means the same as said first liner; said second swage means being disposed adjacent and below said second annular body portion with said stinger portion extending concentrically upwardly interiorly of said second annular body portion; whereby said first and second swage means can be forced interiorly of said first and second body portions to force said body portions into said tight frictional and sealing engagement with said conduit and form a straddle patch with a bore extending longitudinally therethrough.

14. The combination of claim 13 wherein said elongate sleeve comprises a plurality of sections that are joined together to form a long straddle patch.

15. The combination of claim 9 wherein said swage means has a critical taper radially inward along the longitudinal axis in the direction in which the swage means will be moved to expand said annular body portion outwardly into said tight frictional engagement with said conduit; said critical taper being within the range of 1°–5°.

16. The combination of claim 15 wherein said taper is within the range of 1½–3°.

17. The combination of claim 9 wherein a resilient seal means is disposed peripherally about each said annular body portion such that said seal means is compressed into sealing engagement with the interior wall of said conduit and the exterior wall of said body portion when said body portion is expanded into said tight frictional engagement with said conduit.

18. A combination of liner and apparatus for setting the liner in conduit in a well penetrating subterranean formations comprising:

a. a first liner including:

i. an annular body portion having substantially cylindrical interior and exterior surfaces that are at least partially co-extensive, having an outside diameter less than the diameter of said conduit, having sufficient malleability for and adapted for being expanded to conformingly engage said conduit, and having a modulus of elasticity in compression sufficient to retain tight frictional engagement with said conduit after expansion thereagainst; and ii. tubular swage means disposed adjacent said annular body portion for expanding said annular body portion outwardly into said tight frictional engagement with said conduit; said tubular swage means being adapted for being forced concentrically within said annular body portion for expanding said annular body portion outwardly against and into tight frictional engagement with said conduit;

b. an adapter rod means penetrating through said liner for applying a reaction force to the bottom end of said liner; said adapter rod means being connected adjacent its lower end portion with said liner and having at the other end portion means for engagement with a force generating means for opposing movement of said liner when acted on by a force from said force generating means; and c. setting sleeve means disposed radially of the central axis of said adapter rod means and adjacent said liner and having means for engagement with said force generating means for generating a force on said liner;

one of said force and said reaction force acting upon said swage means of said liner and the other acting on the end of said body portion opposite said swage means such that said swage means is moved concentrically within said body portion and said body portion is expanded into said tight frictional engagement with said conduit while said force and said reaction force are still being applied to said liner; and said liner is thereafter left in said tight frictional engagement with said conduit, with said swage means disposed concentrically within and reinforcing said annular body portion that has been expanded into said tight frictional engagement with said conduit.

19. The combination of claim 18 wherein a presetting alignment means is provided for each said swage means and said body portion to ensure proper insertion of said swage means concentrically within its adjacent body portion.

20. The combination of claim 19 wherein said presetting alignment means comprises a stinger portion disposed concentrically within said body portion and connected with respective said swage means.

21. The combination of claim 18 wherein a resilient seal means is disposed peripherally about each said annular body portion such that said seal means is compressed into sealing engagement with the interior wall of said conduit when said body portion is expanded into said tight frictional engagement with said conduit.

22. The combination of claim 18 wherein said swage means has a critical radially inward taper within the range of 1°–5° along the longitudinal axis of the swage means in the direction in which said swage means will be moved to ensure successful insertion and retention of said swage means within said annular body portion for a successful setting of said liner.

23. The combination of claim 22 wherein said taper is within the range of 1½-3°.

24. The combination of claim 18 wherein said swage means is disposed above said annular body portion and engages said setting sleeve means for applying said force for moving said swage means within said annular body portion; and said adapter rod means is connected with the bottom end of said annular body portion at a location spaced below the lowest point to which said swage means will be driven; said adapter rod means being releasable for removal from the well following the setting of said liner.

25. The combination of claim 24 wherein said adapter rod means is connected with the bottom end of said liner via a reaction force setting means comprising a shearable element.

26. The combination of claim 25 wherein said liner has a tubular element suspended therebelow; said tubular element has an annular groove on its interior wall surface; and said reaction force setting means comprises collet fingers that are slidably connected with said adapter rod means; a base that is connected with said adapter rod means and disposed intermediate said collet fingers and said adapter rod means for holding said collet fingers in engagement with said annular groove, and movable, following parting of said partable element, from beneath said collet fingers to allow said collet fingers to spring inwardly for being withdrawn upwardly through said liner.

27. The combination of claim 18 wherein said liner and its elements are given the nomenclature of said first liner including said first annular body portion and said first swage means; said first liner is connected at its lower end with a connector means; said connector means having an expansible portion that is connected to said first annular body portion; said connector means being connected at its other end with a tubular element in the form of an elongate sleeve; said elongate sleeve being connected at its bottom end with a second connector means; said second connector means having an expansible portion; a second liner is connected at its upper end with said second expansible portion of said second connector means; said second liner including a second said annular body portion and a second said swage means having the characteristics of said first annular body portion and first swage means, respectively; said adapter rod means penetrates through said tubular element and said first and second liners and is connected with said second liner adjacent the end of said second swage means opposite said second annular body portion; and said setting sleeve means engages said first swage means adjacent the end opposite said first annular body portion such that upon actuation of a force generating means for setting said liners, respective said swage means are forced concentrically within said annular body portions to force said annular body portions outwardly into tight frictional engagement with said conduit for emplacing a straddle patch that blocks fluid communication between the interior of said conduit and the exterior of said conduit in said well.

28. The combination of claim 27 wherein said first swage means is located above said first annular body portion; and said second swage means is disposed at the bottom end of said second annular body portion; said setting sleeve means engages said first swage means and said adapter rod means is connected with said second swage means via a reaction force setting means that comprises a partable element.

29. The combination of claim 28 wherein said second swage means has an interior annular groove in its interior wall surface; and said reaction force setting means comprises collet fingers that are slidably connected with said adapter rod means; a base that is connected with said adapter rod means and disposed intermediate said collet fingers and said adapter rod means for holding said collet fingers in engagement with said annular groove, and movable, following parting of said partable element from beneath said collet fingers to allow said collet fingers to spring inwardly for being withdrawn upwardly through said liners.

30. The combination of claim 29 wherein each of said adapter rod and said setting sleeve means are operatively connected with one each of a piston assembly of a setting tool and a cylinder assembly of said setting tool for transmission respectively of said force and said reaction force for effecting setting of said liners; said setting tool being actuatable from the surface for generating said force and reaction force.

31. A combination packer assembly for a conduit in a well penetrating subterranean formations having a given diameter comprising:

a. a liner including:

i. an annular body portion having substantially cylindrical interior and exterior surfaces that are at least partially coextensive, having an outside diameter less than said given diameter, having sufficient malleability for and adapted for being expanded to conformingly engage said conduit, and having a modulus of elasticity in compression sufficient to retain tight frictional and sealing engagement with said conduit after expansion thereagainst; and ii. tubular swage means disposed adjacent said annular body portion for expanding said annular body portion outwardly into said tight frictional engagement with said conduit; said tubular swage means being adapted for being forced concentrically within said annular body portion for expanding said annular body portion into said tight frictional and sealing engagement with said conduit;

b. a connector means connected at its one end with said body portion; said connector means having an expansible portion for retaining a sealing interconnection after expansion of said body portion;

c. a seal sub connected to the other end of said connector means and having a longitudinally extending internal sealing surface defining a bore for receiving in sealing relationship a large bore seal unit; and d. settable retainer means retaining said seal sub at a set depth by supplementing the force exerted by said annular body portion and said swage means when said swage means has been moved concentrically interiorly of and expanded said body portion into said tight frictional and sealing engagement with said conduit; said retainer means being connected with said seal sub; said retainer means having a pre-set outside diametral dimension less than said given diameter and being expansible out into positive mechanical engagement with said conduit upon setting of said combination; and being lockable into its expanded and set position; whereby said packer assembly can be emplaced at a given location in said conduit by expansion of said annular body portion into frictional and sealing engagement with said conduit and by expansion of said retainer means into positive mechanical engagement with said conduit; and said packer assembly will remain locked into its set position and will resist being displaced upwardly or downwardly against an unusually large force, such as by a weight and the force of a pressure acting thereon.

32. The combination of claim 31 wherein a presetting alignment means is provided for each said swage means and said body portion to ensure proper insertion of said swage means concentrically within its adjacent body portion.

33. The combination of claim 32 wherein said presetting alignment means comprises a stinger portion disposed concentrically within said body portion and connected with respective said swage means.

34. The combination of claim 31 wherein a resilient seal means is disposed peripherally about each said annular body portion such that said seal means is compressed into sealing engagement with the interior wall of said conduit when said body portion is expanded into said tight frictional engagement with said conduit.

35. The combination of claim 31 wherein said swage means is disposed above said annular body portion and engages a setting sleeve means for applying said force for moving said swage within said annular body portion; and an adapter rod means extends through said liner and is connected with the bottom end of said annular body portion at a location spaced below the lowest point to which said swage means will be driven; said adapter rod means being releasable at said location for removal from the well following the setting of said liner by a force generating means.

36. The combination of claim 31 wherein said swage means has a radially inward taper within the range of 1°–5° along the longitudinal axis of the swage means in the direction in which said swage means will be moved to ensure satisfactory insertion and retention of said swage means within said annular body portion.

37. The combination of claim 36 wherein said taper is within the range of 1½-3°.

38. A combination straddle patch that is settable in two operations, comprising:

a. a packer assembly for a conduit in a well penetrating subterranean formations and having a given diameter comprising:

i. a first liner including:

A. a first annular body portion having substantially cylindrical interior and exterior surfaces that are at least partially co-extensive, having an outside diameter less than said given diameter, having sufficient malleability for and adapted for being expanded to conformingly engage said conduit, and having a modulus of elasticity in compression sufficient to retain tight frictional and sealing engagement with said conduit after expansion thereagainst; and B. a first tubular swage means disposed adjacent said first annular body portion for expanding said first annular body portion outwardly into said tight frictional engagement with said conduit; said first swage means being adapted for being forced concentrically within said first annular body portion for expanding said first annular body portion into said tight frictional and sealing engagement with said conduit;

ii. a first connector means connected at its one end with said first body portion; said first connector means having a first expansible portion for retaining a sealing interconnection after expansion of said first body portion;

iii. a seal hub connected to the other end of said connector means and having a longitudinally extending internal sealing surface defining a bore for receiving in sealing relationship a large bore seal unit; and iv. settable retainer means retaining said seal sub at a set depth by supplementing the force exerted by said first annular body portion and said first swage means when said first swage means has been moved concentrically interiorly of and expanded said first body portion into said tight frictional and sealing engagement with said conduit; said retainer means being connected with said seal sub; said retainer means having a pre-set outside diametral dimension less than said given diameter and being expansible out into positive mechanical engagement with said conduit upon setting of said combination; and being lockable into its expanded and set position; whereby said packer assembly can be emplaced at a given location in said conduit by expansion of said first annular body portion into tight frictional and sealing engagement with said conduit and by expansion of said retainer means into positive mechanical engagement with said conduit; and said packer assembly will remain locked into its set position for receiving an elongate liner assembly sealingly inserted thereinto; and b. an elongate liner assembly comprising:

i. a second liner including:

A. a second annular body portion having substantially cylindrical interior and exterior surfaces that are at least partially co-extensive, having an outside diameter less than said given diameter, having sufficient malleability for and adapted for being expanded to conformingly engage said conduit, and having a modulus of elasticity in compression sufficient to retain tight frictional engagement with said conduit after expansion thereagainst; and B. a second tubular swage means adjacent said second body portion for expanding said second body portion outwardly into tight frictional and sealing engagement with said conduit; said second swage means being adapted for being forced interiorly of said second body portion and left in place therein after said second body portion has been expanded into said tight frictional and sealing engagement with said conduit;

ii. an elongate tubular element comprising an elongate sleeve for serving as a patch;

iii. a second connector means connected at its one end with said body portion and at its other end with said tubular element; said second connector means having a second expansible portion for retaining a sealing interconnection after expansion of said body portion; and iv. a seal unit sealingly connected with the bottom end of said sleeve and adapted for sealing insertion within said sealing bore of a previously set said packer assembly.

39. The combination of claim 38 wherein a presetting alignment means is provided for each said swage means and said body portion to ensure proper insertion of said swage means concentrically within its adjacent body portion.

40. The combination of claim 39 wherein said presetting alignment means comprises a stinger portion disposed concentrically within said body portion and connected with respective said swage means.

41. The combination of claim 38 wherein a resilient seal means is disposed peripherally about each said annular body portion such that said seal means is compressed into sealing engagement with the interior wall of said conduit when said body portion is expanded into said tight frictional engagement with said conduit.

42. The combination of claim 38 wherein said second swage means is disposed above said second annular body portion and engages a setting sleeve means for applying said force for moving said second swage within said second annular body portion; and an adapter rod means extends through said liner and is connected with the bottom end of said second annular body portion at a location spaced below the lowest point to which said swage means will be driven; said adapter rod means being releasable at said location for removal from the well following the setting of said liner by a force generating means.

43. The combination of claim 38 wherein said swage means has a radially inward taper within the range of 1°–5° along the longitudinal axis of the swage means in the direction in which said swage means will be moved to ensure satisfactory insertion and retention of said swage means within said annular body portion.

44. The combination of claim 43 wherein said taper is within the range of 1½-3°.

* * * * *